United States Patent [19]

Degner et al.

[11] 4,110,210

[45] Aug. 29, 1978

[54] DISPERSED GAS FLOTATION PROCESS

[75] Inventors: Vernon R. Degner, Citrus Heights; William V. Colbert, Lodi, both of Calif.

[73] Assignee: Envirotech Corporation, Menlo Park, Calif.

[21] Appl. No.: 791,102

[22] Filed: Apr. 26, 1977

Related U.S. Application Data

[63] Continuation of Ser. No. 583,072, Jun. 2, 1975, abandoned.

[51] Int. Cl.[2] ..... B03D 1/02; B03D 1/24

[52] U.S. Cl. ..... 210/44; 209/164; 209/170; 210/221 P

[58] Field of Search ..... 209/168, 170, 164; 210/44, 221 M, 221 P; 261/76, 78 A, 121 R, 123, DIG. 75

[56] References Cited

U.S. PATENT DOCUMENTS

| | | | |
|---|---|---|---|
| 1,025,782 | 5/1912 | Brownback | 261/76 |
| 1,141,243 | 6/1915 | Foster | 261/76 X |
| 1,380,650 | 6/1921 | Hebbard | 209/170 |
| 1,380,665 | 6/1921 | Lyster | 209/170 |
| 2,385,153 | 9/1945 | Morton | 261/76 X |
| 2,519,606 | 8/1950 | Sharp | 210/44 X |
| 2,883,169 | 4/1959 | Daman | 209/170 X |
| 2,938,629 | 5/1960 | Hollingsworth et al. | 209/170 |
| 3,371,779 | 3/1968 | Hollingsworth et al. | 209/170 X |
| 3,446,353 | 5/1969 | Davis | 209/170 X |
| 3,550,917 | 12/1970 | Cochran | 261/121 R |
| 3,645,892 | 2/1972 | Schulman | 210/44 |
| 3,679,056 | 7/1972 | Haymore | 210/221 P |
| 3,761,065 | 9/1973 | Rich et al. | 261/76 |

FOREIGN PATENT DOCUMENTS

| | | | |
|---|---|---|---|
| 2,353 of | 1916 | Australia | 210/221 P |
| 1,303,163 | 1/1973 | United Kingdom | 210/221 P |

*Primary Examiner*—Charles N. Hart
*Assistant Examiner*—Robert H. Spitzer
*Attorney, Agent, or Firm*—Robert E. Krebs; Hal J. Bohner

[57] ABSTRACT

A flotation process wherein hydraulic effects are used to disperse gas bubbles throughout a contained liquid body with a free surface. The process comprises ejecting a two-phase fluid into the liquid body with the density and the kinetic energy of the ejected fluid per unit of the contained volume being such as to define a point within the area encompassed by Regions I and II in the graph of FIG. 2.

24 Claims, 5 Drawing Figures

DISPERSED GAS FLOTATION PROCESS

This is a continuation of application Ser. No. 583,072, filed June 2, 1975, now abandoned.

BACKGROUND OF THE INVENTION

1. Field of the Invention

The present invention generally relates to an improved process for fully distributing gas bubbles throughout a liquid body in order to accomplish solid-liquid or liquid-liquid separation by flotation.

2. State of the Art

Gas flotation techniques are commonly used for separating and concentrating valuable minerals and chemicals, for removing contaminating particulates from liquid bodies and for separating various liquids (e.g., oil and water). For example, a typical flotation process in the mineral beneficiation art includes the steps of conditioning an aqueous pulp or slurry of crushed ore with a chemical flotation aid and then dispersing air bubbles within the pulp to produce a surface froth relatively rich in the desired mineral. In the field of oil production, similar flotation processes are frequently used to separate crude oil from water prior to the reinjection of the water into a well or prior to surface disposal of the water. In all flotation processes it is important to maximize contact between the froth-producing gas bubbles and the materials which are to be floated. Therefore, it is important that the gas bubbles be distributed throughout the liquid body. Another requirement is that the surface of the liquid body be maintained fairly quiescent so that the froth is not agitated to cause the floated materials to separate from the gas bubbles to which they have become attached.

Various processes have been proposed to satisfy the afore-mentioned requirements. In one well-known type of machine, a rotatable impeller aspirates gas into a liquid body in a vessel and, at the same time, agitates the liquid to distribute the gas within the vessel. An example of that type of machine is shown in U.S. Pat. No. 3,491,880 to W. H. Reck. In another type of flotation machine it has been proposed to use one or more gas injection nozzles in combination with a baffle arrangement to accomplish gas distribution within a liquid body. Machines generally of that type are shown in U.S. Pat. Nos. 2,008,624; 3,371,779; and 3,446,353.

Another type of flotation machine for mineral applications is the cascade machine; cascade machines, which were historically of quite small cell volume, have been obsolete for many years. Examples of cascade machines are shown in U.S. Pat. No. 1,380,665 to F. J. Lyster and U.S. Pat. No. 1,311,919 to Seale and Shellshear.

OBJECTS OF THE INVENTION

The general object of the present invention is to provide an improved dispersed gas flotation process to accomplish solid-liquid or liquid-liquid separation. A more particular object is to provide a new and improved process for ejecting a two-phase fluid (typically an air-water mixture) into a contained liquid body in a relatively nonturbulent manner which provides a nearly complete dispersion or distribution of gas bubbles throughout the body and a quiet but frothy surface.

The process of the present invention can be carried out with the apparatus generally described hereinafter and by the apparatus that is more particularly described in our copending U.S. patent application Ser. No. 595,906, filed July 14, 1975.

BRIEF DESCRIPTION OF THE DRAWINGS

Further objects and advantages of the present invention may be readily ascertained by reference to the following description and appended drawings which are offered by way of illustration only and not in limitation of the invention, whose scope is defined by the appended claims and equivalents to the acts recited therein. In the drawings:

DETAILED DESCRIPTION OF THE PREFERRED EMBODIMENT

Figure 1:
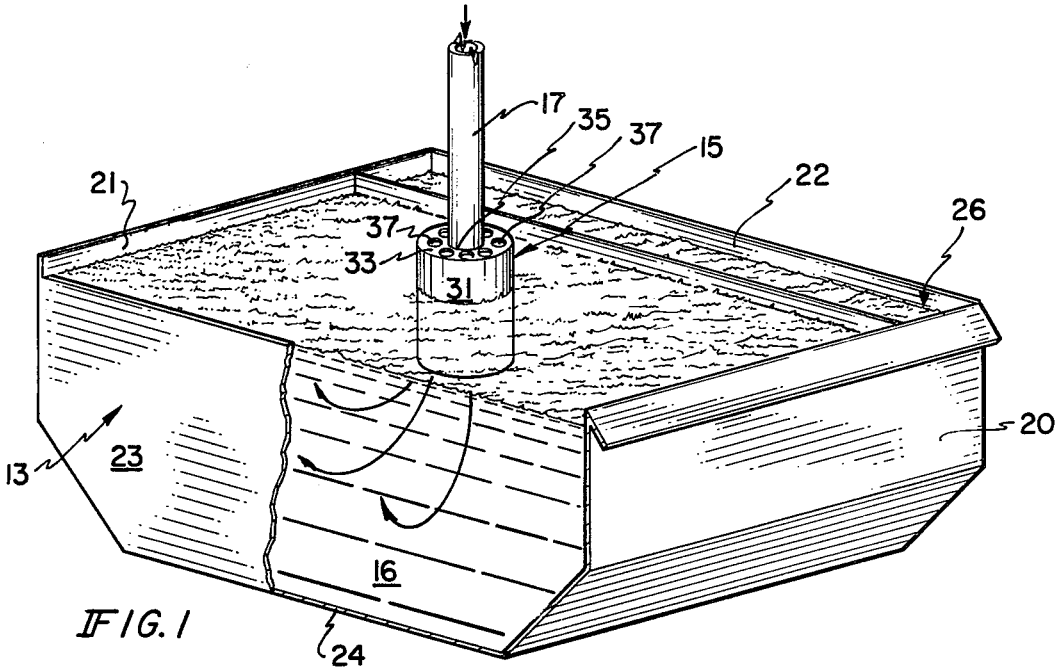
FIG. 1 is a schematic diagram, in perspective, of a machine for practicing the process of the present invention.

A dispersed gas flotation process according to our present invention can be practiced with a machine such as the one shown in FIG. 1 which includes a tank 13 wherein a body of liquid 16 is contained with a free surface, and a single ejection device 15 fixedly supported centrally at the free surface of the liquid to expel a two-phase fluid (typically an air-water mixture) downwardly into the liquid body 16 from a generally medial position relative to the tank. A conventional pump, not shown, is provided to force liquid into the ejection device 15 via a liquid-carrying pipe 17. The illustrated tank 13, which is exemplary only, is defined by upstanding marginal sidewalls 20–23 and a generally flat bottom 24. It may be noted that the machine does not include any distribution baffles nor any mechanical agitators. At least one of the sidewalls of the tank, say wall 23, serves as a weir over which froth from the surface of the liquid body flows to discharge; to aid in the froth removal, a conventional auxiliary skimming device such as a rotatable paddle (not shown) could also be provided. Pulp or other material for treatment is introduced into the tank 13 via a conventional feeder box 26 or by an inlet duct or the like. Processed liquid is removed from the tank beneath a conventional underflow weir (not shown) or by other typical means such as an effluent duct. If desired, the removed liquid can be repumped through the ejection device 15.

The dispersed gas flotation machine can use several conventional types of fluid ejection devices. For example, the ejection device can be a gas-aspirating nozzle, an eductor or an exhauster. Preferably, the ejection device is of the expansion-chamber type which, as shown in FIG. 1, includes a relatively short tubular member 31 of circular cross-section which is connected to the distal end of the liquid-carrying pipe 17 and which defines a chamber of large diameter relative to the pipe. Preferably, the tubular member 31 is fixedly secured to the pipe 17 by a flat annular plate 33 having a central opening 35 which receives the pipe end and having a plurality of small orifices 37 formed about the central opening. As liquid is pumped from the pipe into the tubular member 31, gas is aspirated through the orifices 37 and becomes entrained with the liquid to provide the aforementioned two-phase fluid mixture. The exit end of the tubular member 31 is open and unobstructed; preferably, that end is positioned below the free surface of the liquid body 16 so the effluent from the ejection device does not disturb the stability of froth on the liquid surface.

Figure 2:
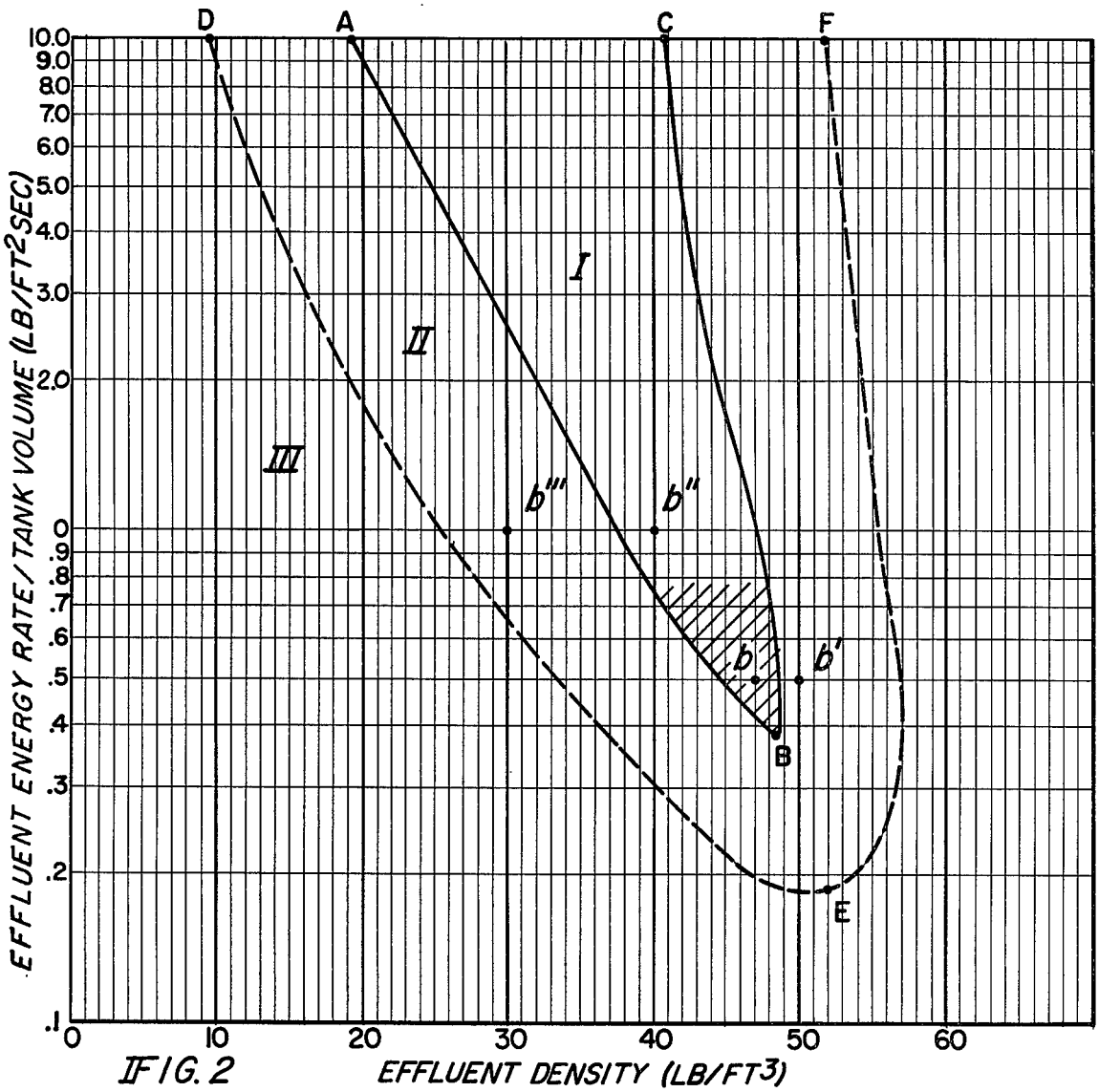
FIG. 2 is a graph illustrating the preferred conditions under which the process is practiced.

According to the present invention, the machine of FIG. 1 is operated such that certain energy-density relationships shown in FIG. 2 are maintained. In the graph in that figure, the vertical axis (ordinate) represents the kinetic energy rate of the two-phase effluent from the ejection device 15 in terms of foot-pound force per cubic-foot volume of the receiving tank 13 per second, and the horizontal axis (abscissa) represents the density of the two-phase effluent from the ejection device in terms of pound force (weight) per cubic foot. The area I generally bounded by the solid curve ABC in the graph describes the preferred operating region of the machine. Surrounding that region is a transition region II whose outer boundary is defined by the dashed curve DEF. Outside that boundary is Region III, the so-called undesirable operating region. When the machine is operated under Region I conditions, the liquid body in the tank is filled with gas bubbles and the liquid surface is relatively quiet but frothy. However, if the machine is operated under Region III conditions, either the gas bubbles are not distributed throughout the liquid body or the liquid surface is excessively turbulent or choppy.

It should be noted that the abscissa of the graph in FIG. 2 is a linear scale on which density values are shown ranging from 10 to 62.4 pounds per cubic foot. Those values are based on tests where the effluent was an air-water mixture. Since the density of water is 62.4 pounds per cubic foot, the density of the two-phase gas-water mixture would necessarily be less than that. It should also be noted that the ordinate is a logarithmic scale and that the energy rates of the two-phase effluent range from one-tenth to ten pounds per square foot per second.

In a sense, the curve AB defines a minimum energy boundary because a point on that curve defines, with respect to a particular effluent density, the minimum energy that can be expended to achieve the desired conditions. In actual practice, we prefer to operate at an energy level above the curve AB in order to provide a margin of safety. Likewise, the curve BC can be understood to define a maximum energy boundary because a point on that curve defines, with respect to a particular effluent density, the maximum energy which can be expended while still maintaining the desired conditions. In practice, we prefer to operate at energy levels well below the boundary BC in order to conserve power. For that reason, the exact location of the curve BC is unimportant except to illustrate that the desired conditions will cease to exist if the two-phase effluent energy is too great.

From FIG. 2, one could also observe that it would be preferable to operate at an energy-density point generally within the shaded area of the nose region of the curve ABC if energy usage were to be minimized. We have found, however, that operation there is not desirable from a reliability standpoint because slight changes in the values of the operating parameters can readily give rise to undesirable conditions in the tank. For example, if the machine were set to operate at point *b* and the effluent density shifted to a point *b'* (about a 10% increase), the desired conditions in the liquid body would deteriorate. Such shifts in the operating parameters could result from hydraulic or air blockages and plugging, variations in pump speed, normal mechanical wear experienced during use, and so forth. Therefore, we usually operate substantially to the left and above the shaded area of the nose of Region I, say at point *b''* in the unshaded portion of the region.

Operation at a point such as *b''* in Region I which is substantially removed from the shaded area is also preferable for the reason that efficient flotation requires enough gas to provide a large number of bubbles to contact the material which is to be floated. Since the quantity of gas which is introduced to the liquid body in the illustrated machine is inversely related to the density of two-phase effluent from the ejection device 15, and since the number of bubbles is a generally increasing function of the quantity of gas, operation at point *b''* (low density) is normally preferred to operation at point *b* (high density) when the number of gas bubbles is a consideration. (The quantitative relationship of the density of the two-phase fluid, $\rho 2\phi$, to the gas flow $Q_A$ and the liquid flow $Q_L$ can be represented by the following expression:

$$\rho 2\phi = \frac{62.4}{1 + \frac{Q_A}{Q_L}}$$

It should be noted that we are discussing here the relative number of bubbles and not the distribution of the bubbles; the bubbles can, of course, be distributed throughout the tank whether there are relatively many or relatively few bubbles.

Preferably, the two-phase fluid ejection device 15 is positioned with its outlet end slightly below the liquid surface such that the gas-liquid mixture emanating therefrom impinges upon or sweeps the tank floor. The condition of impingement depends upon the depth of the tank as well as the energy of the two-phase effluent. From our observations, we believe that the impingement (or "near" impingement, as that term will be explained hereinafter) on the tank floor is important in achieving good gas bubble distribution and a quiet liquid surface with minimum power usage.

In that regard, we have observed what we call a "hysteresis" effect and believe that effect partly explains the transition Region II shown in FIG. 2. We have observed that, as the ejection energy is increased while maintaining the two-phase fluid density constant, a critical value is reached where the tank suddenly fills with bubbles and the free surface becomes quiet. It was quite surprising to observe such a discontinuous phenomenon. Moreover, we have found that once the critical energy value is surpassed, we could thereafter reduce the ejection energy while maintaining a constant nozzle effluent density and that the tank remains filled with bubbles until an energy value was reached below the prior critical value. In other words, the energy value at which the bubble distribution changes from uniform to non-uniform depends upon whether one is decreasing the energy from a point within Region I or whether one is increasing the energy from a point in Region III to reach a point within Region I. Thus, the boundary AB of Region I is the locus of energy values at which the preferred conditions will arise as the ejection energy is increased from a point in Region III and the dashed boundary DE of the transition Region II is the locus of points where the preferred conditions will cease as the ejection energy is decreased from a point within Region I. The hysteresis effect, we believe, may be closely related to the impingement of the ejected two-phase fluid on the tank bottom. By taking advantage of that effect, we are able to reliably operate at values slightly inside the minimum energy boundary AB because even if the effluent density should decrease, say by shifting from point $b''$ in Region I to $b'''$ in Region II, the preferred conditions in the tank would still persist.

In view of the hysteresis effect, the curve AB can be understood to define the minimum energy levels at which one is assured of achieving the preferred conditions within the liquid body. In still other words, the minimum energy required for assurance of the preferred conditions is a function of the two-phase effluent density, and that function is shown by curve AB.

During operation, the FIG. 2 abscissa and ordinate values at which the machine is operating can be determined by skilled workers in several ways. For example, the density of the ejected two-phase fluid can be calculated from the aforementioned expression. The liquid and gas flow rates into the ejection device 15 ($Q_L$ and $Q_A$, respectively) are readily measurable with a conventional venturi meter, a rotameter, a pitot-static device or the like, or are determinable from pump operating conditions. Knowing the tank volume, the gas and liquid flow rates, and the density of the two-phase effluent, one can readily determine the kinetic energy rate ($\frac{1}{2}mv^2/g$) of the two-phase fluid per unit of tank volume, where "$m$" is defined as the two-phase fluid "mass" flow rate (in pounds weight per second) as determined by the density and pipe-geometry relationship, "$v$" is the effluent velocity of the two-phase mixture in feet per second and "$g$" is the gravitational constant 32.2 ft/sec$^2$. Here again, we emphasize that the ordinate values shown in FIG. 2 are in terms of the volume of the liquid body held in the tank 13; thus, for example, if the tank volume is doubled and the two-phase effluent density is held constant, the two-phase effluent energy must also be doubled in order to maintain the preferred flotation conditions and to establish the same operating point in FIG. 2. Normally, the effluent energy of the two-phase fluid is adjusted by varying the speed or flow of the pump which supplies the liquid to the ejection device 15, or by varying the fluid stagnation pressure at the ejection device 15. We have determined the graph of FIG. 2 by tests conducted with tank volumes ranging from 0.83 to 60 cubic feet and believe the illustrated range applies to flotation cells over a 1000:1 volume range.

The method of operation according to this invention may now be contrasted with the method of operation of the previously mentioned impeller-driven flotation machines. In such machines, impeller rotation aspirates gas into a liquid body, but also creates substantial agitation and shear within the liquid. Such conditions discourage flotation to the extent that the gas bubbles may have difficulty in remaining attached to the specie which is to be floated. In the process of the present invention, by way of contrast, a natural hydraulically actuated effect is utilized to accomplish flotation or, more specifically, the complete filling and mixing of a contained liquid body with gas bubbles without violent agitation and with a minimum of shear turbulence in the flotation vessel. The complete filling of the liquid body with gas bubbles and the circulation of the bubbles optimizes contact between the gas bubbles and material which is to be floated. It should be noted that the natural hydraulic effect also allows the process to be carried out without baffles or other mechanical gas distribution means.

Figure 3:
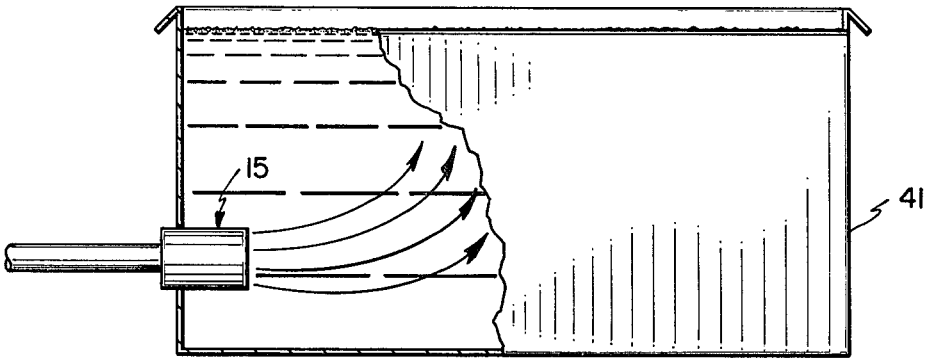
FIG. 3 is a schematic diagram, drawn as a side sectional view, of an alternative embodiment of a machine for practicing the process of the present invention.

FIG. 3 shows an embodiment of a flotation machine wherein the two-phase fluid is introduced into a vessel 41 by an injection device 15 like the one shown in FIG. 1 but the device is arranged to eject from a medial position generally horizontally into the lower region of the liquid body held in the vessel 41. This embodiment is illustrated only to emphasize that direction of ejection relative to the tank is not critical to the achievement of the desired hydraulic effects or characteristics in the liquid body. Although the tank 13 in FIG. 1 and the vessel 41 in FIG. 3 are both open-topped, covers could be provided so long as the liquid still retains a free surface upon which the froth can form for purposes of flotation.

The direction of ejection of the two-phase fluid into the liquid body has been found to cause a current in the froth which forms on the liquid surface. More specifically, the surface froth has been found to flow generally in a direction governed by the nozzle attitude. Small changes in the ejection device attitude can therefore be used to cause a froth current in lieu of the aforementioned froth skimming devices.

Figure 4:
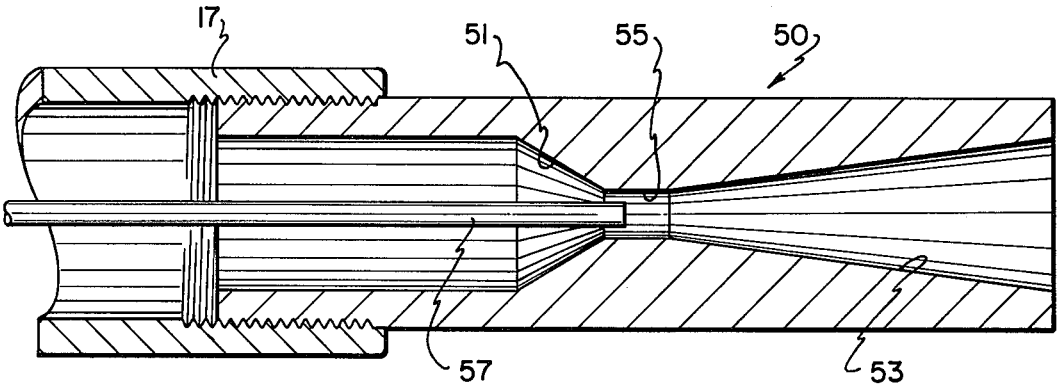
FIGS. 4 and 5 are detail views, drawn as elevations in section, of two alternative embodiments of an ejection device for use in practicing the invention.

In FIG. 4, an alternative type of two-phase fluid ejection device 50 comprises a venturi-like nozzle which is fitted to the distal end of the liquid-carrying pipe 17. The nozzle has a relatively rapidly converging entrance section 51, a relatively slowly diverging exit section 53 and a constricted throat 55. A gas-carrying tube 57 is provided to convey gas into the throat 55 either by pumping or by natural aspiration. Preferably, this nozzle is operated so that there is sonic flow at the throat 55 and supersonic flow in the diverging section 53; under such conditions, a shock wave is created in the diverging section 53 and that increases mixing between the gaseous and liquid phases flowing through the nozzle.

Figure 5:
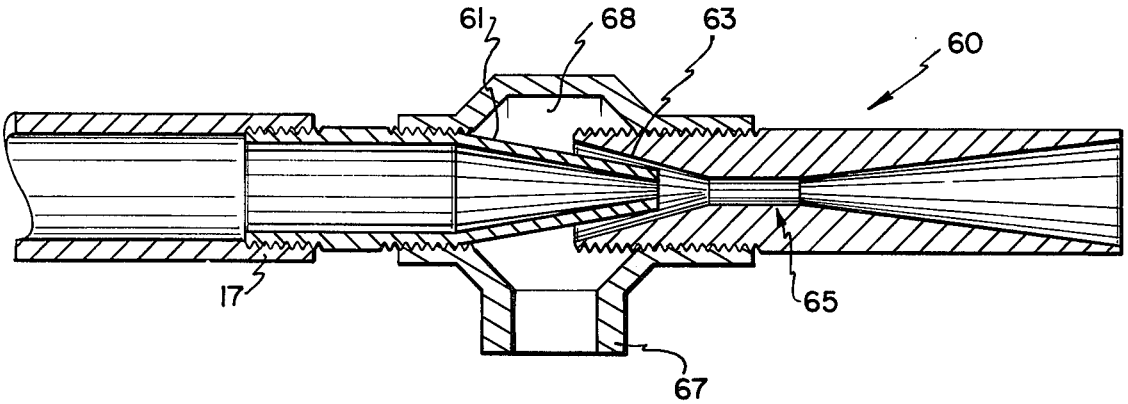

In FIG. 5, there is illustrated still another alternative type of two-phase fluid ejection device suitable for practicing the present invention. The ejection device 60 shown there includes a converging frusto-conical tubular member 61 which is fitted to the distal end of the liquid-carrying pipe 17 and which is concentrically and spacedly arranged in the converging section 63 of a converging-diverging nozzle 65 similar to the one described in connection with FIG. 4. A gas inlet member 67 is provided to introduce gas into a chamber 68 which surrounds both the outlet end of the frusto-conical tubular member 61 and the inlet end of the converging-diverging nozzle 65. In operation, liquid is pumped through the frusto-conical member 61 to create a suction which draws gas into the chamber 68 and then into the converging-diverging nozzle 65 for mixing with the liquid flow.

We claim:

1. A dispersed gas flotation process wherein hydraulic effects are used to disperse gas bubbles throughout a contained liquid body with a free surface, said process comprising: pumping a two-phase fluid into the liquid body through an ejection device with the density and the kinetic energy rate of the ejected fluid per unit volume of the contained body at the point of ejection being defined by a point on the graph of FIG. 2 within the area encompassed by Region I.

2. A process according to claim 1 wherein the two-phase fluid is initially pumped through the ejection device and ejected into the liquid body with the two-phase fluid having sufficient kinetic energy rate and density to define a point within the area encompassed by Region I in the graph of FIG. 2 and then decreasing the pumping energy so that the kinetic energy rate and the density of the ejected two-phase fluid define a point within the area encompassed by Region II of the graph of FIG. 2.

3. A process according to claim 1 wherein the two-phase fluid is ejected downwardly into the contained liquid body.

4. A process according to claim 1 wherein the two-phase fluid is ejected downwardly into the contained liquid body from a position below the free surface.

5. A process according to claim 4 including the step of adjusting the attitude at which the two-phase fluid is ejected into the contained liquid body to create a current of froth at the free surface of said contained liquid body.

6. A process according to claim 1 wherein the two-phase fluid is ejected generally horizontally into the contained liquid body from a position below the free surface.

7. A process according to claim 1 wherein the two-phase fluid is ejected downwardly into the contained liquid body from a position below the free surface such that the ejected fluid sweeps the floor of the container.

8. A process according to claim 1 wherein the liquid body is contained in a vessel without baffles.

9. A process according to claim 1 wherein the two-phase fluid is ejected from a position generally medially relative to the tank.

10. The process according to claim 1 wherein the two-phase fluid is a gas-water mixture.

11. A process according to claim 1 wherein the liquid body is contained in a vessel and the two-phase fluid is ejected downwardly into the vessel from a position below the free surface of the liquid body with the kinetic energy rate and the density of the two-phase fluid being such that the ejected two-phase fluid impinges upon the floor of the vessel.

12. A process according to claim 1 wherein the two-phase fluid is ejected from a converging-diverging type of nozzle.

13. A process according to claim 12 wherein said nozzle is operated to achieve sonic flow conditions at its throat.

14. A process according to claim 1 wherein the two-phase fluid is ejected from an expansion chamber type of device.

15. A process according to claim 14 wherein the liquid phase of the two-phase fluid is water which is pumped into the expansion chamber, and the other phase is gas which is mixed into the water in the expansion chamber by aspiration.

16. A dispersed gas flotation process according to claim 1 wherein the density of the ejected two-phase fluid is less than 62.4 lbs/ft$^3$.

17. A process according to claim 1 wherein the kinetic energy rate of the ejected fluid per unit volume of the contained body at the point of ejection is less than about 10 pounds per square foot-second.

18. A dispersed gas flotation process wherein hydraulic effects are used to disperse gas bubbles throughout a contained liquid body with a free surface, said process comprising: pumping a two-phase fluid into the liquid body through an ejection device with the density and the kinetic energy rate at the point of ejection of the ejected fluid per unit volume of the contained body being defined by any point on the graph of FIG. 2 within the area encompassed by Region I and maintaining the density and kinetic energy rate within said Region I, thereby to achieve a relatively quiet but frothy surface on the liquid body and to fill the liquid body with gas bubbles.

19. A process according to claim 18 wherein the two-phase fluid is ejected downwardly into the contained liquid body from a single ejection device positioned generally medially relative to the tank.

20. A process according to claim 18 wherein, after the two-phase fluid is initially pumped through the ejection device and ejected into the liquid body with the two-phase fluid having sufficient kinetic energy rate and density to define a point within the area encompassed by Region I in the graph of FIG. 2, the pumping energy is decreased so that the kinetic energy rate and the density of the ejected two-phase fluid define a point within the area encompassed by Region II of the graph of FIG. 2 and the density and kinetic energy rate is maintained within said Region II.

21. A process according to claim 20 wherein the kinetic energy rate of the ejected fluid per unit volume of the contained body at the point of ejection is less than about 10 pounds per square foot-second.

22. A process according to claim 18 wherein the kinetic energy rate of the ejected fluid per unit volume of the contained body at the point of ejection is less than about 10 pounds per square foot-second.

23. A dispersed gas flotation process wherein hydraulic effects are used to disperse gas bubbles throughout a contained liquid body with a free surface, said process comprising: pumping a two-phase fluid into the liquid body through an ejection device with the density and the kinetic energy rate of the ejected fluid per unit volume of the contained body at the point of ejection being defined by a point on the graph of FIG. 2 within the area encompassed by Region I adjacent the shaded area of the nose region of the curve ABC.

24. A process according to claim 23 wherein the kinetic energy rate of the ejected fluid per unit volume of the contained body at the point of ejection is less than about 10 pounds per square foot-second.

* * * * *